US009309716B2

(12) United States Patent
Chen

(10) Patent No.: US 9,309,716 B2
(45) Date of Patent: Apr. 12, 2016

(54) TRANSMISSION MECHANISM OF WINDOW COVERING

(71) Applicant: NIEN MADE ENTERPRISE CO., LTD., Taichung (TW)

(72) Inventor: Lin Chen, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/466,812

(22) Filed: Aug. 22, 2014

(65) Prior Publication Data

US 2016/0053533 A1 Feb. 25, 2016

(51) Int. Cl.
*E06B 9/322* (2006.01)
*E06B 9/324* (2006.01)
*E06B 9/326* (2006.01)

(52) U.S. Cl.
CPC ..... *E06B 9/322* (2013.01); *E06B 9/324* (2013.01); *E06B 9/326* (2013.01); *E06B 2009/3222* (2013.01)

(58) Field of Classification Search
CPC ..... E06B 9/3222; E06B 2009/3222; E06B 2009/3225; E06B 9/322
USPC ..... 160/170, 171, 84.04, 84.05, 84.06
See application file for complete search history.

(56) References Cited

U.S. PATENT DOCUMENTS

| | | | | |
|---|---|---|---|---|
| 2,420,301 | A * | 5/1947 | Cusumano | 160/170 |
| 6,325,131 | B1 * | 12/2001 | Dekker et al. | 160/170 |
| 6,575,223 | B1 * | 6/2003 | Chung et al. | 160/170 |
| 6,622,769 | B2 * | 9/2003 | Judkins | 160/84.05 |
| 6,889,741 | B1 * | 5/2005 | Cheng et al. | 160/170 |
| 6,991,020 | B1 * | 1/2006 | Cheng et al. | 160/168.1 R |
| 7,185,691 | B2 * | 3/2007 | Toti | 160/173 R |
| 7,950,437 | B2 * | 5/2011 | Lin | 160/168.1 R |
| 2004/0188038 | A1 | 9/2004 | Nien | |

* cited by examiner

*Primary Examiner* — David Purol
(74) *Attorney, Agent, or Firm* — Ming Chow; Sinorica, LLC

(57) ABSTRACT

A transmission mechanism of a window covering includes a first lifting cord set, a second lifting cord set, and a driving cord set. The driving cord set has a cone reel and a control cord, wherein the cone reel has a gradually decreasing dimension, and the control cord winds around the cone reel and has a section left out of the headrail. The first and the second lifting cord sets each has a reel and a lifting cord, wherein the reel is driven by the cone reel, and the lifting cord has opposite ends fastened to the reel and the bottom rail respectively. The cone reel changes a speed and torque of the power transferred to the bottom rail while the user pulls the control cord to lift the bottom cord and the slats of the window covering in an efficient way.

10 Claims, 8 Drawing Sheets

TRANSMISSION MECHANISM OF WINDOW COVERING

BACKGROUND OF THE INVENTION

1. Technical Field

The present invention relates generally to a covering, and more particularly to a transmission mechanism of a window covering, which is capable of efficiently transmitting power to lift the bottom rail and the covering material of the window covering.

2. Description of Related Art

A conventional window covering includes a headrail, a bottom rail, and a covering material between the headrail and the bottom rail. The covering material could be slats, cellular shades, and blanket etc. A typical window covering has at least two lift cords extending out of the headrail, passing through the covering material, and connected to the bottom rail. The lift cords are manipulative to lift and lower the bottom rail and the covering material.

However, when the bottom rail is being lifted, the covering material is stacking up increasingly upon the bottom rail, and it requires more efforts for the user has to lift both the bottom rail and the covering material due to the window covering is getting stacked onto the bottom rail. It is a hard job for the user if it is a big and heavy window covering. Sometime, the user needs to pull the lift cords for several times before the bottom rail is totally lifted.

An early invention of the applicant as taught in U.S. patent publication number 2004/0188038 provides a window covering equipped with a reel in the bottom rail to reduce the power that the user pulls the lift cords. Now, the applicant provides another design.

BRIEF SUMMARY OF THE INVENTION

In view of the above, the primary objective of the present invention is to provide a transmission mechanism of a window covering, which provides an efficient way for the user to lift the bottom rail and the covering material of a window covering.

The present invention provides a transmission mechanism of a window covering, including a first lifting cord set, a second lifting cord set, and a driving cord set. The driving cord set has a cone reel and a control cord, wherein the cone reel is received in the headrail for rotation and the control cord winds around the cone reel and has a section left out of the headrail for manipulation to rotate the cone reel. The first lifting cord set has a first reel and a first lifting cord, wherein the first reel is received in the headrail and driven by the cone reel, and the first lifting cord has opposite ends fastened to the first reel and the bottom rail respectively. The second lifting cord set has a second reel and a second lifting cord, wherein the second reel is received in the headrail and driven by the cone reel, and the second lifting cord has opposite ends fastened to the second reel and the bottom rail respectively.

In an embodiment, the driving cord set further has a transmission reel and a transmission cord; the transmission reel has a reel portion, and the cone reel has a cone portion and a reel portion; the transmission cord winds around the cone portion of the cone reel and the reel portion of the transmission reel respectively, and the control cord winds around the reel portion of the cone reel, whereby the first reel and the second reel are driven by the cone reel to synchronously rotate while the control cord is pulled or released.

In an embodiment, the first reel has a first barrel and a first gear concentrically connected to the first barrel; the second reel has a second barrel and a second gear concentrically connected to the second barrel; the transmission reel further has a third gear concentrically connected to its reel portion; and the third gear of the transmission reel is meshed with both the first gear of the first reel and the second gear of the second reel.

In an embodiment, the cone portion of the cone reel has a tip end and a butt end, and a diameter of the cone portion decreases from the butt end to the tip end; and the transmission cord winds around the cone portion in a direction from butt end to the tip end.

In an embodiment, the cone portion of the cone reel is provided with a spiral slot to receive the transmission cord.

In an embodiment, the first reel has a first barrel and a first gear concentrically connected to the first barrel; the second reel has a second barrel and a second gear concentrically connected to the second barrel; the cone reel has a cone portion and a gear concentrically connected to the cone portion; the control cord winds around the cone portion of the cone reel; and the gear of the cone reel is meshed with both the first gear of the first reel and the second gear of the second reel.

In an embodiment, the first reel has a first barrel and a first gear concentrically connected to the first barrel; the second reel has a second barrel and a second gear concentrically connected to the second barrel; the cone reel has a cone portion and a gear concentrically connected to the cone portion; the control cord winds around the cone portion of the cone reel; and the gear of the cone reel is meshed with the second gear of the second reel, and the second gear of the second reel is meshed with the first gear of the first reel.

In an embodiment, the first reel has a first barrel and a first gear, and the first barrel and the first gear are concentrically connected together; the second reel has a second barrel and a second gear, and the second barrel and the second gear are concentrically connected together; the cone reel further has a gear, which is concentrically connected to the cone portion; and the gear of the cone reel is indirectly connected to the first gear of the first reel and the second gear of the second reel respectively through intermediate gears.

In an embodiment, the first reel has a first barrel and a first gear, and the first barrel and the first gear are concentrically connected together; the second reel has a second barrel and a second gear, and the second barrel and the second gear are concentrically connected together; the cone reel further has a gear, which is concentrically connected to the cone portion; and the gear of the cone reel is indirectly connected to the first gear of the first reel and the second gear of the second reel respectively through timing belts.

In an embodiment, the transmission mechanism further includes a cord locker provided in the headrail, wherein the control cord passes through the cord locker.

Whereby, the cone reel has a changing dimension which changes a speed and torque of the power transferred to the bottom rail while the user pulls the control cord to lift the bottom cord and the covering material of the window covering in an efficient way.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
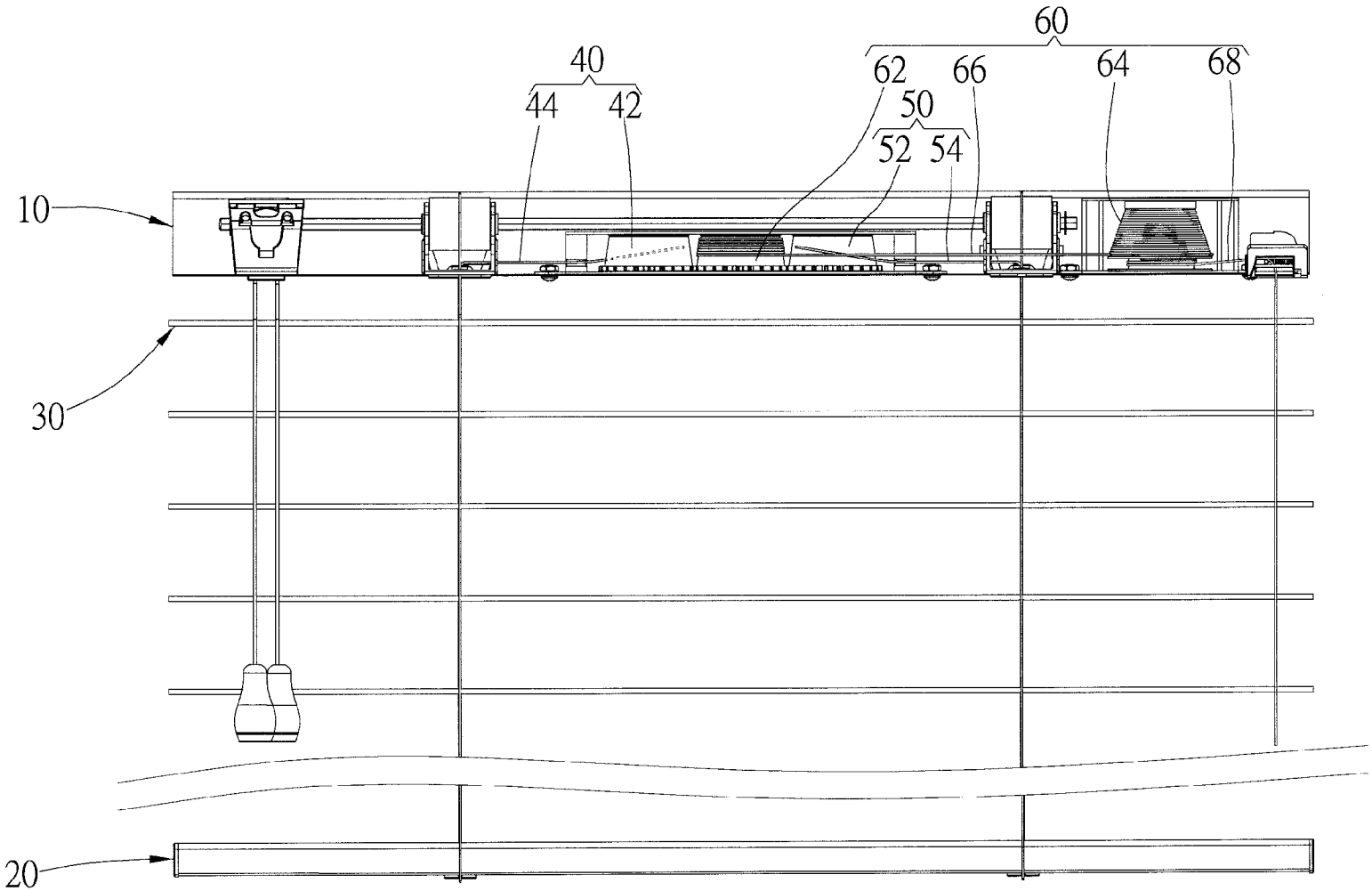
FIG. 1 is a perspective view of a first preferred embodiment of the present invention, showing the bottom rail being lowered.

As shown in FIG. 1, it shows a window covering of the first preferred embodiment of the present invention, including a headrail 10, a bottom rail 20, and a covering material between the headrail 10 and the bottom rail 20. In the present embodiment, the covering material includes a plurality of slats 30 arranged parallel to the headrail 10 and the bottom rail 20. The window covering further includes a transmission mechanism, which has a first lift cord set 40, a second lift cord set 50, and a driving cord set 60.

Figure 2:
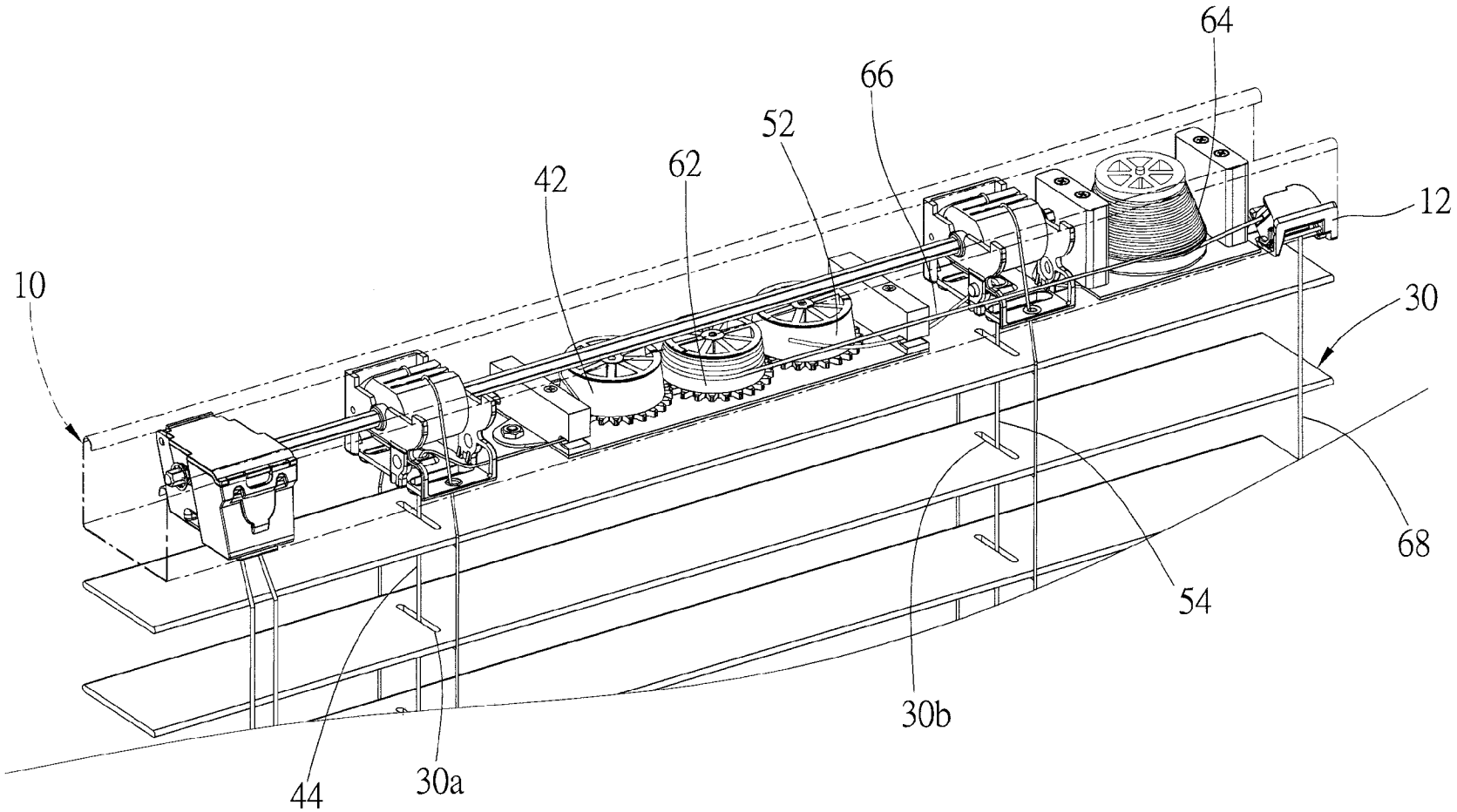
FIG. 2 is a partial view of FIG. 1.
Figure 3:
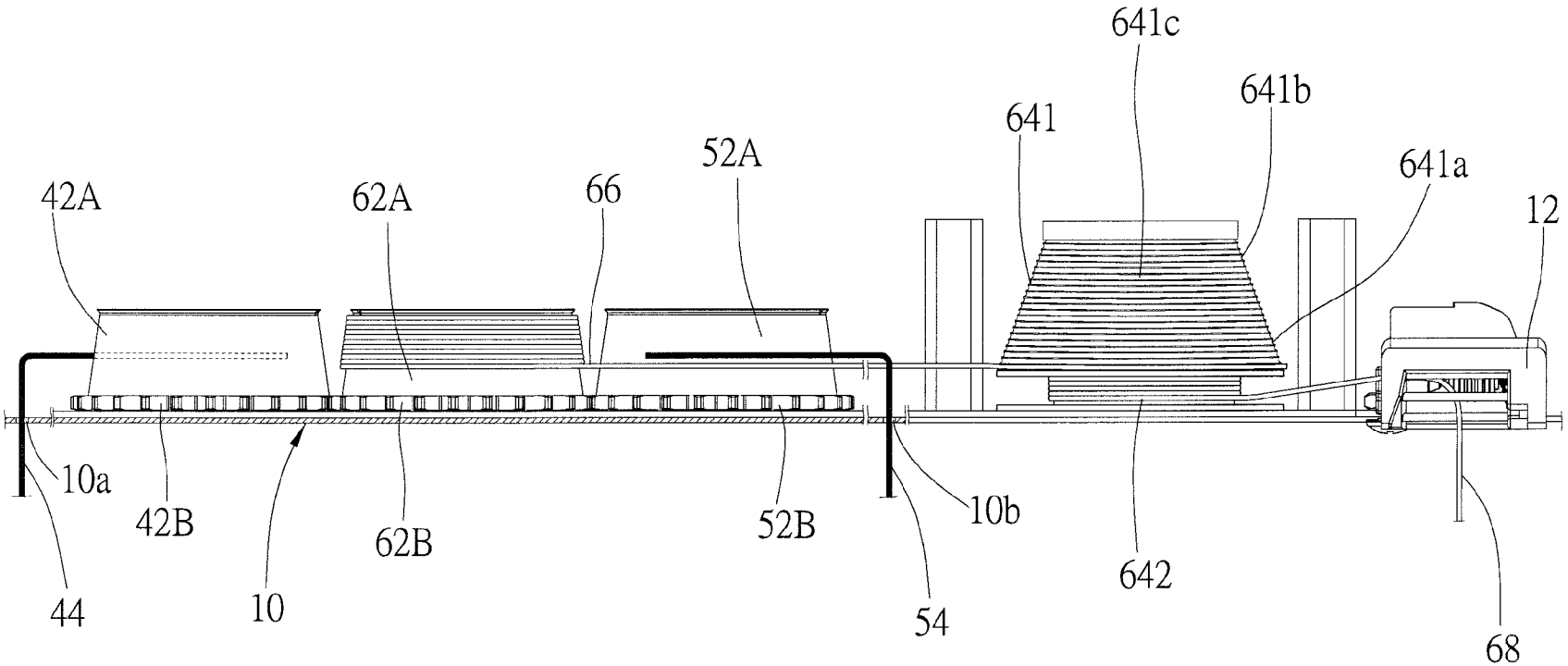
FIG. 3 is a front view of the transmission mechanism of the first preferred embodiment of the present invention, showing the control cord not pulled, and the transmission cord winding around the reel portion.

As shown in FIG. 2 and FIG. 3, the first lift cord set 40 includes a first reel 42 and a first lift cord 44. The first reel 42 is received in the headrail 10, and has a first barrel 42A and a first gear 42B concentrically connected to the first barrel 42A. The first lift cord 44 has an end fastened to the first barrel 42A, and the other end passing through a first bore 10*a* of the headrail 10 and first cord bores 30*a* of the slats 30 in sequence, and then fastened to the bottom rail 20.

The second lift cord set 50 includes a second reel 52 and a second lift cord 54. The second reel 52 is received in the headrail 10, and keeps a distance from the first reel 42. The same as above, the second reel 52 has a second barrel 52A and a second gear 52B, which are concentric, and the second lift cord 54 has an end fastened to the second barrel 52A, and the other end passing through a second bore 10*b* of the headrail 10 and second cord bores 30*b* of the slats 30 in sequence, and then fastened to the bottom rail 20.

Figure 4:
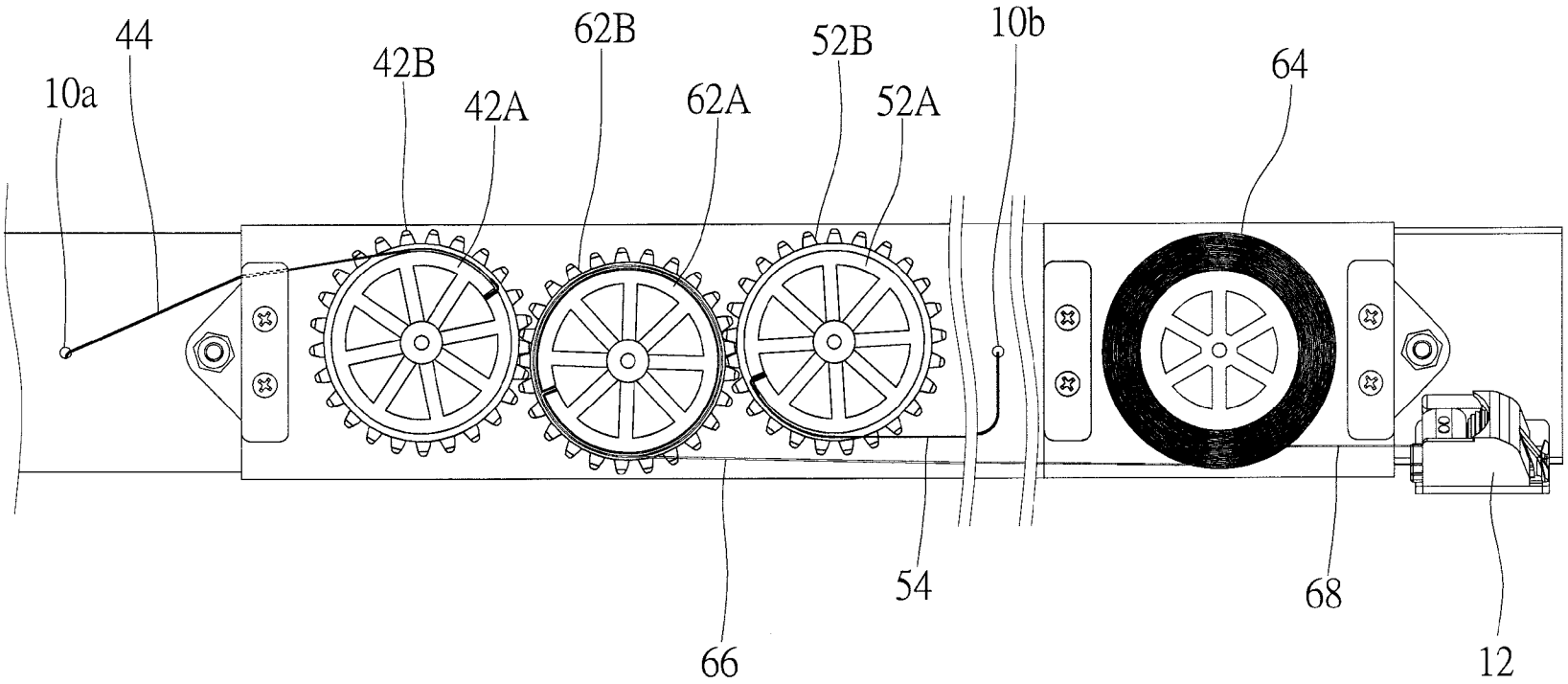
FIG. 4 is a top view of FIG. 3.

The driving cord set 60 includes a transmission reel 62, a cone reel 64, a transmission cord 66, and a control cord 68. As shown in FIG. 3 and FIG. 4, the transmission reel 62 is provided in the headrail 10 between the first reel 42 and the second reel 52 for rotation. The transmission reel 62 has a reel portion 62A and a third gear 62B. In the present embodiment, the third gear 62B is meshed with both the first and the second gears 42B and 52B, therefore the first reel 42 and the second reel 52 are driven to synchronously rotate while the transmission reel 62 is rotating. The cone reel 64 is provided in the headrail 10 for rotation as well, and has a cone portion 641 and a reel portion 642. The cone portion 641 is provided with a spiral slot 641*c* on a surface thereof. The cone portion 641 has a tip end and a butt end, and the diameter of the cone portion 641 gradually decreases in a direction from the butt end to the tip end. In other words, the cone portion 641 has a big dimension section 641*a*, which is adjacent to the butt end, and a small dimension section 641*b*, which is adjacent to the tip end, wherein a dimension of the big dimension section 641*a* is greater than that of the small dimension section 641*b*. The reel portion 642 is connected to the butt end (the big dimension section 641*a*) of the cone portion 641.

The transmission cord 66 of the driving cord set 60 has opposite ends fastened to the reel portion 62A of the transmission reel 62 and the big dimension section 641*a* of the cone reel 64 respectively. The control cord 68 has an end fastened to the reel portion 642 of the cone reel 64 and the other end passing through a cord locker 12 of the headrail 10, and then extending out of the headrail 10.

In the first preferred embodiment, as shown in FIG. 1, the control cord 68 winds around the reel portion 642 of the cone reel 64 in a counterclockwise direction before passing through the cord locker 12, and the transmission cord 66 winds around the reel portion 62A of the transmission reel 62 in a counterclockwise direction before being fastened to the big dimension section 641*a* of the cone reel 64. As a result, the cone reel 64 and the transmission reel 62 rotate in the same direction while the control cord 68 is pulled or released. In another embodiment, the control cord 68 and the transmission cord 66 wind in opposite directions, therefore the cone reel 64 and the transmission reel 68 rotate in different directions while the control cord 68 is pulled.

The first lift cord 44 has an end fastened to the first barrel 42A, but does not wind therearound. The other end of the first lift cord 44 passes through the first bore 10*a* of the headrail 10, and then is fastened to the bottom rail 20. The second lift cord 54, similar to the first lift cord 44 has an end fastened to the second barrel 52A, but does not wind therearound, and the other end passing through the second bore 10*b* of the headrail 10, and then being fastened to the bottom rail 20. In another embodiment, the first and the second lift cords 44, 54 wind around the first and the second barrels 42A, 52A with a few loops before being fastened to the bottom rail 20. It may reduce the loadings of the lift cords so as to avoid the lift cords unfastened to the barrels 42A, 52A.

Figure 5:
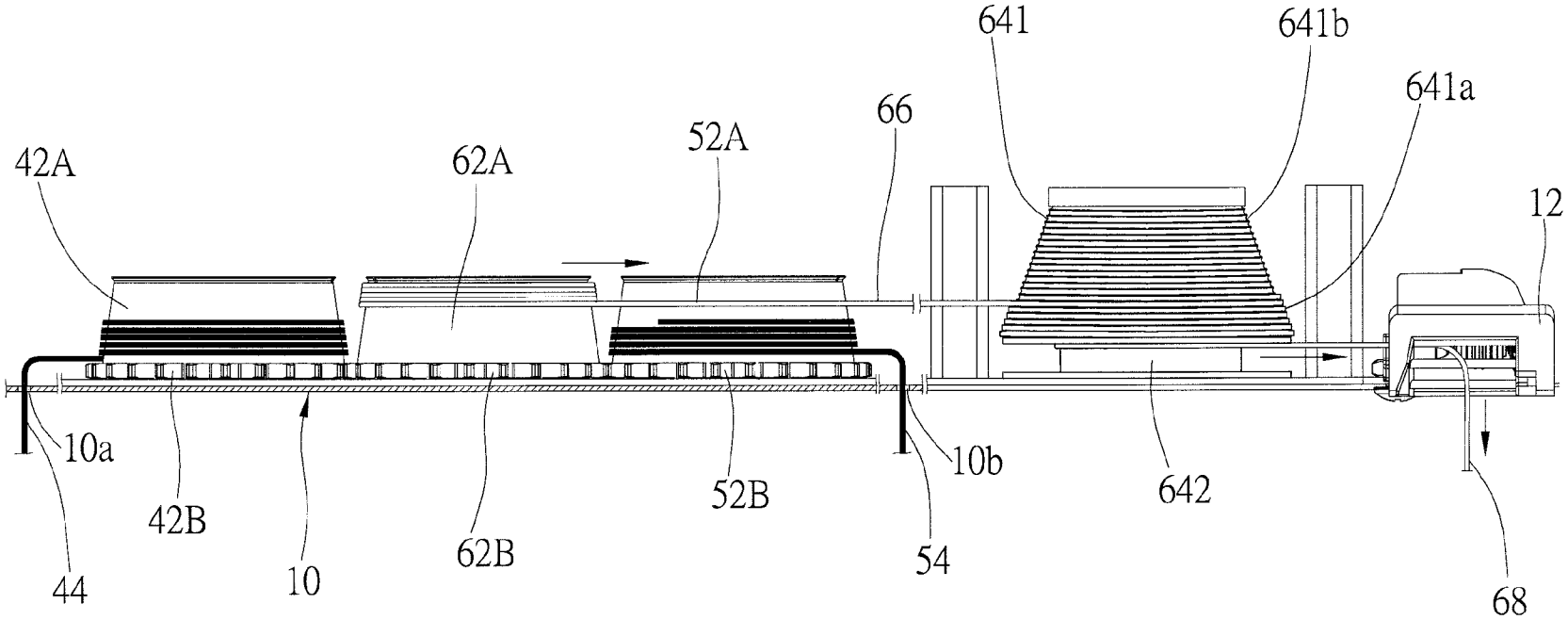
FIG. 5 is similar to FIG. 3, showing the control cord being pulled, and some of the transmission cord winding around the cone reel.
Figure 6:
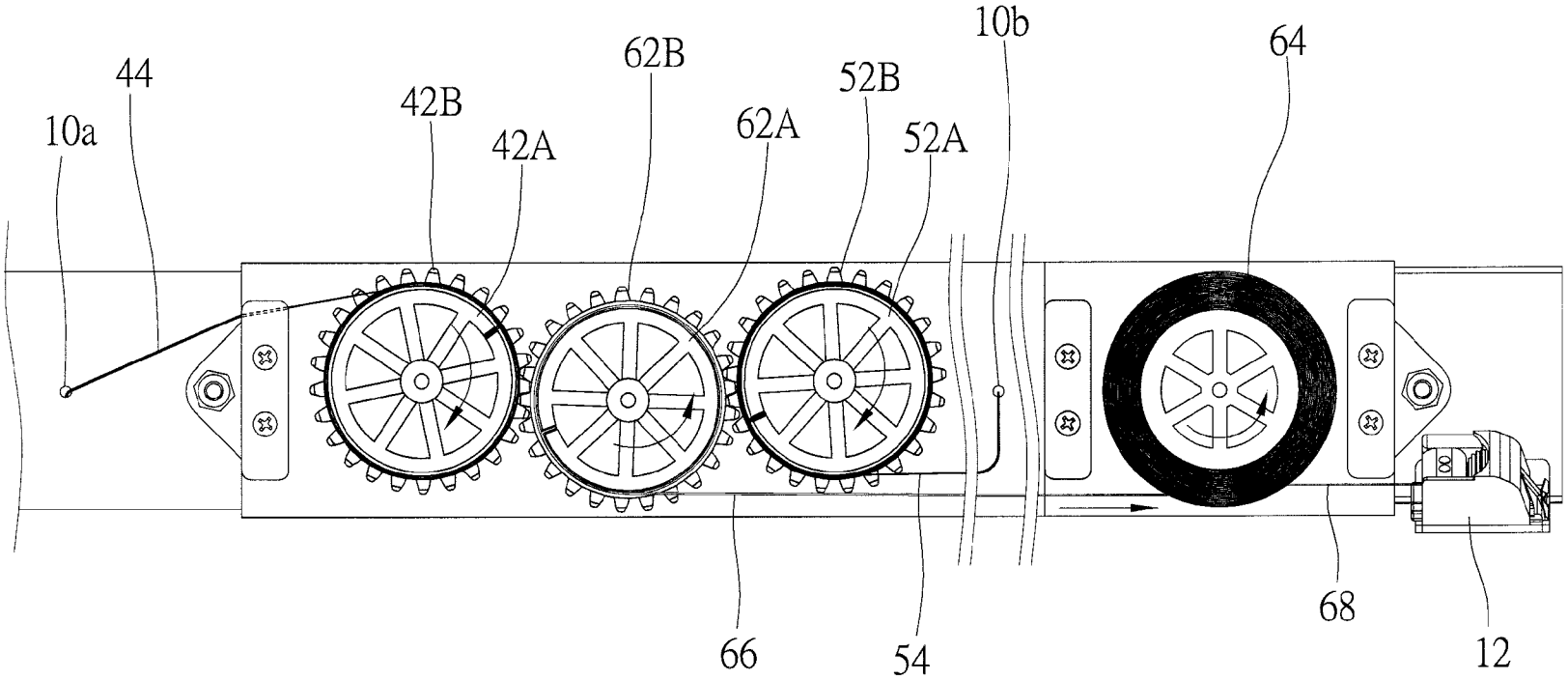
FIG. 6 is a top view of FIG. 5.

As shown in FIG. 5 and FIG. 6, while a user pulls the control cord 68, it will rotate the cone reel 64 and draw the transmission cord 66 from the transmission reel 62 to be wound around the cone portion 641 in a direction from the butt end to the tip end (from the big dimension section 641*a* to the small dimension section 641*b*). As a result, the transmission reel 62 is rotated at the same time, and the first and the second reels 42, 52 are driven to rotate by the transmission reel 62 through the meshed gears 42B, 52B, 62B.

As shown in FIG. 6, the first and the second reels 42, 52 are rotating clockwise while the transmission reel 62 is rotating counterclockwise. In order to ensure that the first and the second lift cords 44, 54 synchronously wind around the first and the second barrels 42A, 52A to lift the bottom rail 20 smoothly and evenly, the present embodiment provides that a position of the first lift cord 44 leaving the first barrel 42A is opposite to that of the second lift cord 54 leaving the second barrel 52A. It may make the first and the second barrels 42A, 52A wind or release the first and the second lift cords 44, 54 at the same time. In other words, the first and the second lift cords 44, 54 must wind around the first and the second barrels 42A, 52A in the same direction to avoid the situation of one barrel winding the lift cord, and the other releasing the lift cord.

The structure of the transmission reel 62 between the first and the second reels 42, 52 makes sure that both the first and the second lift cords 44, 54 synchronously lift the bottom rail 20. Except that, it may provide the transmission reel 62 beside the second lift cord 54 to have the third gear 62B directly or indirectly meshed with the second gear 52B, and the second gear 52B meshed with the first gear 42B (the directions of the cords winding around the reels must change accordingly).

In the first preferred embodiment, there are three cord sets, and the cords of the cord sets may drive the reels to rotate in an efficient way to avoid the problem of the prior art and enhance the durability of each cord. In addition, due to the cone reel 64 having a gradually decreasing dimension, therefore a ratio of dimension of the cone reel 64 and the transmission reel 62 is changing while the user pulls the control cord 68. The change of the ratio of dimension changes a speed and a torque transferred to the transmission reel 62. In the beginning of lifting the bottom rail 20, only the bottom rail 20 and a few slats 30 are lifted, and the transmission cord 66 wind around the big dimension section 641*a* of the cone reel 64, it rotates the transmission reel 62 quickly and provides a small torque. As a result, a fast and small lifting power is provided to lift the bottom rail 20 and the slats 30 in an efficient way. As the bottom rail 20 continuously being lifted, more and more slats 30 are stacked on the bottom rail 20, so that the weight to lift is getting heavier. At this time, the transmission cord 66 on the cone reel 64 winds around the small dimension section 641*b*, which rotates the transmission reel 62 slowly and provides a large torque. Therefore, when the user pulls the control cord 68, the bottom rail 20 will be lifted quickly in the beginning, and gradually get slowly, and the torque for lifting the bottom rail 20 and the slats 30 is small in the beginning, and gradually increases.

Figure 7:
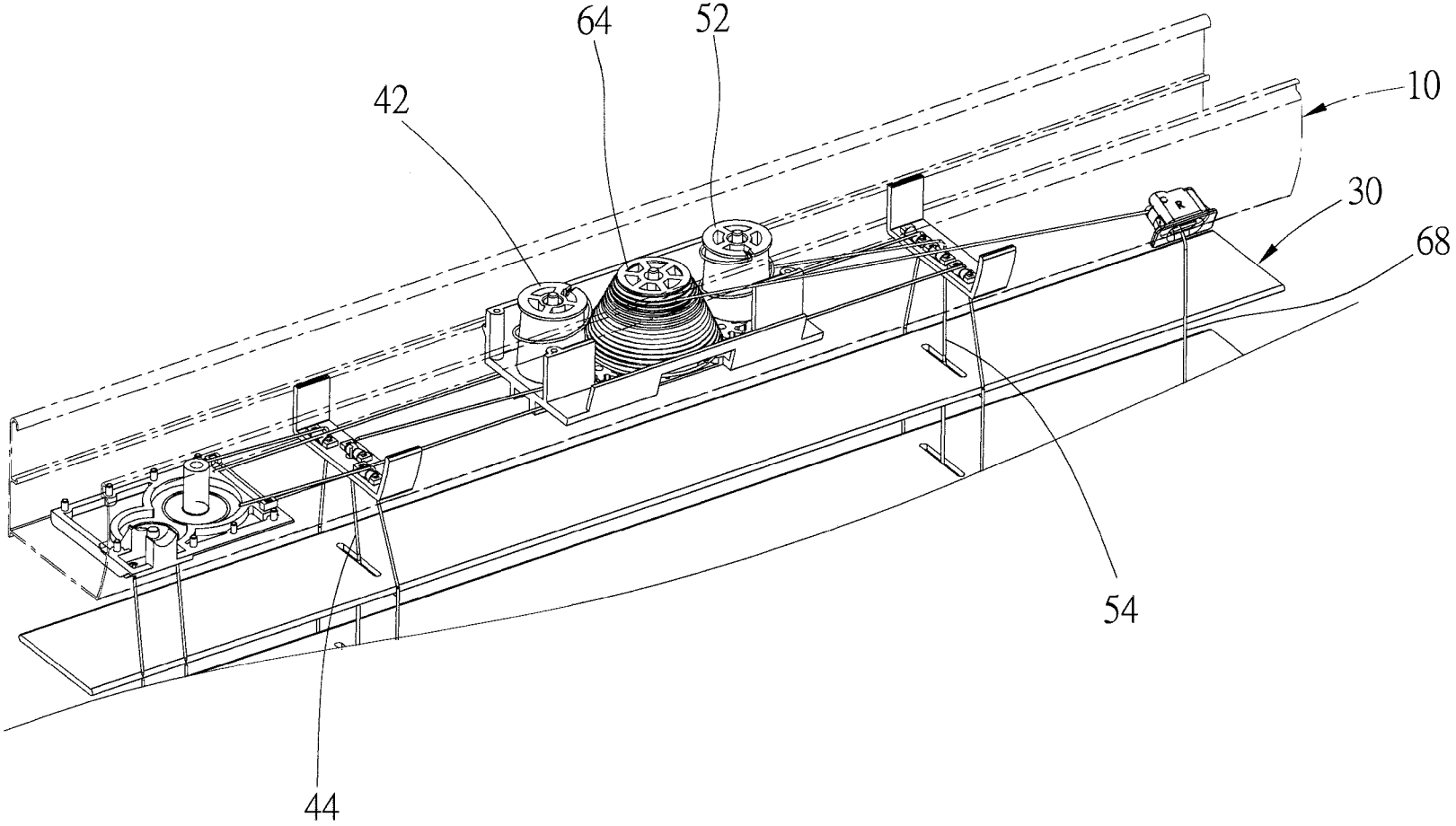
FIG. 7 is a partial view of a second preferred embodiment of the present invention, showing the cone reel and the lift cord sets.
Figure 8:
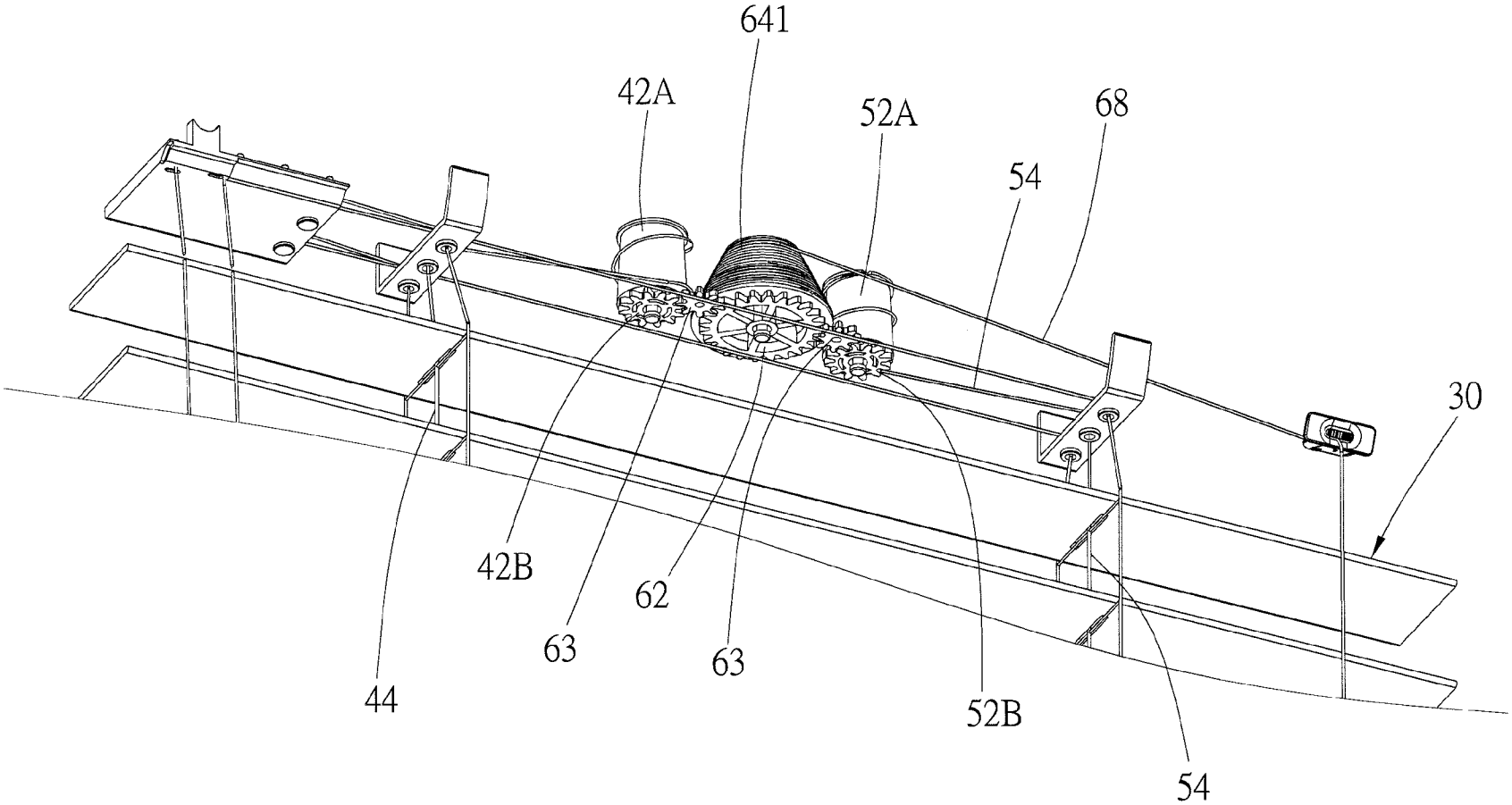
FIG. 8 is another partial view of the second preferred embodiment of the present invention, showing the driving cord set having two transmission gears.

FIG. 7 and FIG. 8 show a transmission mechanism of the second preferred embodiment of the present invention, which is similar to the first preferred embodiment, except that a cone reel 64 is between the first reel 42 and the second reel 52, and is provided with a gear 62, which is concentrically connected to the butt end of the cone portion 641. The gear 62 can be directly meshed with the gears 42B and 52B of the first and the second reels 42 and 52, or alternatively, the gear 62 can be indirectly meshed with the gears 42B, 52B of the first and the second reels 42, 52 through two intermediate gears 63 as shown in FIG. 8. A control cord 68 winds around the cone portion 641 of the cone reel 64 directly. The transmission mechanism of the second preferred embodiment works with the same function as the first preferred embodiment without the transmission reel and the transmission cord.

The function of the intermediate gears 63 is to keep a sufficient space between the cone reel 64 and the first and the second reels 42, 52 for the cords to pass through to avoid twisting. In an embodiment, the intermediate gears 63 are replaced by timing belts to be looped over the gear 62 and the gears 42B, 52B.

It must be pointed out that the embodiments described above are only some preferred embodiments of the present invention. All equivalent structures which employ the concepts disclosed in this specification and the appended claims should fall within the scope of the present invention.

What is claimed is:

1. A transmission mechanism of a window covering, wherein the window covering includes a headrail, a bottom rail, and a covering material between the headrail and the bottom rail, comprising:

a first lifting cord set having a first reel and a first lifting cord, wherein the first reel is received in the headrail for rotation, and the first lifting cord has opposite ends fastened to the first reel and the bottom rail respectively;

a second lifting cord set having a second reel and a second lifting cord, wherein the second reel is received in the headrail for rotation, and the second lifting cord has opposite ends fastened to the second reel and the bottom rail respectively; and a driving cord set having a cone reel and a control cord, wherein the cone reel is received in the headrail for rotation to drive the first reel and the second reel to synchronously rotate, and the control cord winds around the cone reel and has a section left out of the headrail for manipulation to rotate the cone reel, wherein the driving cord set further has a transmission reel and a transmission cord; the transmission reel has a reel portion, and the cone reel has a cone portion and a reel portion; the transmission cord winds around the cone portion of the cone reel and the reel portion of the transmission reel respectively, and the control cord winds around the reel portion of the cone reel, whereby the first reel and the second reel are driven by the cone reel to synchronously rotate while the control cord is pulled or released.

2. The transmission mechanism of claim 1, wherein the first reel has a first barrel and a first gear concentrically connected to the first barrel; the second reel has a second barrel and a second gear concentrically connected to the second barrel; the transmission reel further has a third gear concentrically connected to the reel portion thereof; and the third gear of the transmission reel is meshed with both the first gear of the first reel and the second gear of the second reel.

3. The transmission mechanism of claim 1, wherein the first reel has a first barrel and a first gear concentrically connected to the first barrel; the second reel has a second barrel and a second gear concentrically connected to the second barrel; the transmission reel further has a third gear concentrically connected to the reel portion; and the third gear of the transmission reel is meshed with the second gear of the second reel, and the second gear of the second reel is meshed with the first gear of the first reel.

4. The transmission mechanism of claim 1, wherein the cone portion of the cone reel has a tip end and a butt end, and a diameter of the cone portion decreases from the butt end to the tip end; and the transmission cord winds around the cone portion in a direction from butt end to the tip end.

5. The transmission mechanism of claim 4, wherein the cone portion of the cone reel is provided with a spiral slot to receive the transmission cord.

6. The transmission mechanism of claim 1, wherein the first reel has a first barrel and a first gear concentrically connected to the first barrel; the second reel has a second barrel and a second gear concentrically connected to the second barrel; the cone reel has a cone portion and a gear concentrically connected to the cone portion; the control cord winds around the cone portion of the cone reel; and the gear of the cone reel is meshed with both the first gear of the first reel and the second gear of the second reel.

7. The transmission mechanism of claim 1, wherein the first reel has a first barrel and a first gear concentrically connected to the first barrel; the second reel has a second barrel and a second gear concentrically connected to the second barrel; the cone reel has a cone portion and a gear concentrically connected to the cone portion; the control cord winds around the cone portion of the cone reel; and the gear of the cone reel is meshed with the second gear of the second reel, and the second gear of the second reel is meshed with the first gear of the first reel.

8. The transmission mechanism of claim 1, wherein the first reel has a first barrel and a first gear, and the first barrel and the first gear are concentrically connected together; the second reel has a second barrel and a second gear, and the second barrel and the second gear are concentrically connected together; the cone reel further has a gear, which is concentrically connected to the cone portion; and the gear of the cone reel is indirectly connected to the first gear of the first reel and the second gear of the second reel respectively through intermediate gears.

9. The transmission mechanism of claim 1, wherein the first reel has a first barrel and a first gear, and the first barrel and the first gear are concentrically connected together; the second reel has a second barrel and a second gear, and the second barrel and the second gear are concentrically connected together; the cone reel further has a gear, which is concentrically connected to the cone portion; and the gear of the cone reel is indirectly connected to the first gear of the first reel and the second gear of the second reel respectively through timing belts.

10. The transmission mechanism of claim 1, further comprising a cord locker provided in the headrail, wherein the control cord passes through the cord locker.

* * * * *